US010667570B2

(12) United States Patent
Oliva

(10) Patent No.: US 10,667,570 B2
(45) Date of Patent: Jun. 2, 2020

(54) STAY TUCKED-IN EASY-ON EASY-OFF STRAPLESS HIDDEN SUSPENDERS

(71) Applicant: Dean Joseph Oliva, Granada Hills, CA (US)

(72) Inventor: Dean Joseph Oliva, Granada Hills, CA (US)

(73) Assignee: Dean J. Oliva, Granada Hills, CA (US)

( * ) Notice: Subject to any disclaimer, the term of this patent is extended or adjusted under 35 U.S.C. 154(b) by 283 days.

(21) Appl. No.: 15/892,828

(22) Filed: Feb. 9, 2018

(65) Prior Publication Data

US 2019/0246726 A1 Aug. 15, 2019

(51) Int. Cl.

| | |
|---|---|
| ***A41F 18/00*** | (2006.01) |
| ***A41F 1/00*** | (2006.01) |
| ***A41F 17/00*** | (2006.01) |
| ***A41F 5/00*** | (2006.01) |

(52) U.S. Cl.

CPC ..... *A41F 18/00* (2013.01); *A41F 1/00* (2013.01); *A41F 5/00* (2013.01); *A41F 17/00* (2013.01)

(58) Field of Classification Search

CPC .... A41F 18/00; A41F 1/00; A41F 5/00; A41F 17/00; A41F 17/02; A41F 19/00

See application file for complete search history.

(56) References Cited

U.S. PATENT DOCUMENTS

| | | | | |
|---|---|---|---|---|
| 1,413,696 | A * | 4/1922 | Werner | A41F 5/00 2/229 |
| 1,792,128 | A * | 2/1931 | Stevenson | A41F 5/00 24/371 |
| 1,831,618 | A * | 11/1931 | Maurice | A41F 5/00 2/337 |
| 5,117,537 | A * | 6/1992 | Hunter | A47C 21/022 24/455 |
| 5,632,069 | A * | 5/1997 | Mievis | A41F 5/00 24/333 |
| 7,398,558 | B1 * | 7/2008 | Kattenhorn | A41F 5/00 2/79 |
| 7,412,730 | B2 * | 8/2008 | Schroeder | A41F 5/00 2/340 |
| 7,784,158 | B2 * | 8/2010 | Doyle | A45F 5/02 24/114.12 |
| 8,327,510 | B2 * | 12/2012 | Schlesinger | A41F 17/02 2/269 |

* cited by examiner

*Primary Examiner* — Steven O Douglas

(57) ABSTRACT

An upper and lower garment disc-like dual connector and suspension device wherein the tucked-in upper garment, such as a shirt or blouse, is draped over and around and captured and held in the disc-like peripheral groove with a retainer device, leaving one disc surface area exposed to the outside of the upper garment for affixing any one of a myriad of fasteners, such as, Velcro, clips, buttons, snaps, hangers, etc., that attaches the upper garment to the lower garment such as pants, trousers, skirts, shorts, etc., behind and below the waistband, so that the upper garment becomes the suspenders of the lower garment. This easy-on, easy-off, transferrable, tucked-in apparel positive connection and suspension concept provides; suspension support of the lower garment, a neat tucked-in appearance at all times, is comfortable to wear, and is not visible from view while maintaining the lower garment in the desired position around the waist.

11 Claims, 3 Drawing Sheets

STAY TUCKED-IN EASY-ON EASY-OFF STRAPLESS HIDDEN SUSPENDERS

This application claims the benefits of U.S. Provisional Application No. 62/600,121, filed Feb. 14, 2017, the disclosure of which is incorporated herein by reference.

Inventor: Dean J. Oliva

No government sponsorship.

BACKGROUND OF THE INVENTION

This invention is in the field of clothing, particularly in how the tucked-in upper garment, be they shirt or blouse, is attached to and supports suspension of the lower garment, they being trousers, shorts, slacks, or skirts, at the desired position on the body to maintain a neat tucked-in appearance while holding up the lower garment.

Prior historical concepts for supporting the lower garment are waist belts and suspenders. The belt, when strung through loops in the lower garment belt line, is tightened around the waist for people of standard shape, supports the lower garment from sliding down the body, mostly by the restraint offered by the hips and the friction of the lower garment pulled tightly against the tucked-in upper garment.

For people lacking protruding hips, people with protruding stomachs, and people with sensitive belt line contact, over the shoulder straps were worn to hold up the lower garment.

Most people refrain from wearing external suspenders because they are style conscience or consider suspender straps unsightly, and/or cumbersome and because hidden under garment suspenders prevent tucked-in upper garment wear without special contraptions where slots are made in the upper garment in order to allow pass through of the under garment suspender strap clips, so they could attach to the lower garment waistband or using under garment straps to affix magnetic devices that squeeze the upper and lower garments together by magnetic force that increases the friction to hold up the lower garment and keep the upper garment tucked-in.

A plurality of other recent hidden support devices such as sticky tape concepts and friction pad devices are only moderately effective at holding the upper garment tucked-in at all times and the lower garment held at the wearer's desired waistline position, especially when the wearer is very active or when one raises their arms, the upper garment pulls out from the lower garment, resulting in the lower garment slipping down the stomach, requiring regular adjustments throughout the day to tuck-in the upper garment and constantly having to pull up the lower garment to the desired waistline position.

Other tucked-in lower garment suspender concepts have included Velcro fastener connection of the upper and lower garments however these concepts require permanent physical attachment to both the upper and lower garments and therefore the concept is not flexible in that all garments must be so facilitated, making the concept inconvenient and not transferable to other garments.

What is needed is a positive upper and lower garment connection method that is strapless, permits the lower garment to be suspended from the upper garment with a device that is hidden from view, keeps the lower garment at the desired position on the body for all physical sizes and shapes of individuals and for any level of physical activity, is easily put on and removed, can be transferred to any other articles of clothing, keeps the lower garment from sliding down the stomach, keeps the upper garment tucked-in at all times, is comfortable to wear, and provides easy removal of the lower garment for daily conveniences.

SUMMARY OF THE INVENTION

The present invention is a dual connector and strapless suspension disc-like device that conveniently holds any tucked-in upper garment, such as a shirt or blouse, without modification or damage to the upper garment and providing an attachment mounting surface as well, to affix any of a plurality of fasteners, such as Velcro, buttons, snaps, hooks, or hangers, to accommodate the positive connection of the tucked-in upper garment to the waistband of the lower garment, such as trousers, pants, shorts, or slacks, at a position hidden below and behind the waistband of the lower garment.

The device is a flat geometric shaped disc with a peripheral edge groove completely around the circumference that holds the upper garment by draping it's material over, around and into the perimeter groove, where it is wedged into and held in the groove with a retainer on the underside of the upper garment, leaving the other disc surface exposed and facing the inside of the lower garment waistband, where any one of a plurality of available fasteners is affixed to connect to the lower garment at the wearer's desired position around the waist.

A round disc is selected for description purposes of the patent although any geometric shaped plane pad could be used as well. The disc can be any size but must provide a sufficiently large surface area to react the forces expected to hold up the lower garment weight in addition to wearer motion forces without folding over on itself, as well as, providing enough upper garment material holding surface area to prevent the upper garment from tearing under these forces.

The thickness of the disc must be sufficient to permit a retainer groove wide enough to hold a double thickness of the upper garment material in addition to the thickness of the retainer device, yet leave enough groove side wall thickness to prevent the upper garment from breaking out of the side walls under expected forces resulting from the weight of the lower garment in addition to wearer motion forces imposed.

The disc can be made from any one or a combination of a plurality of materials such as metal, fiberglass, wood, plastic rubber, and ceramics, that are stiff enough and strong enough to leverage the forces imposed on it from the lower garment weight in addition to wearer motion forces imposed without bending or breaking.

The disc perimeter groove can be any geometric shape of sufficient cross section, depth and width to contain a double thickness of the upper garment material plus the width of the retainer device.

The retainer can be any of a plurality of devices, including metal or plastic rings, wire bands, snap rings, clamps, rubber bands, string, shoe laces, rope, split rings, or any other devices that can be tightened down and locked in place to hold the upper garment in the groove, and can be easily released when desired, yet strong enough to keep from releasing or breaking under the forces exerted by the weight of the lower garment in addition to wearer motion forces.

Fasteners mounted to the disc outer surface, that connect to the lower garment waist band, can be any of a plurality of available fasteners including: Velcro, clips, clamps, buttons, snaps, and hooks, that are substantial enough to withstand the forces imposed by the weight of the lower garment in addition to wearer motion forces.

Any number of the connector and strapless suspension devices can be used at the same time. One or more for children or petit women with two or more for average size individuals and a larger number for heavier or more portly individuals and those with heavy physical activity, larger size devices for heavier individuals and smaller sizes for petit individuals and children.

BRIEF DESCRIPTION OF DRAWINGS

Preferred embodiments of the present invention and explained in further detail below by way of example and with reference to the accompanying drawings which.

DETAILED DESCRIPTION OF THE PREFERRED EMBODIMENT OF THE INVENTION

Figure 1A:
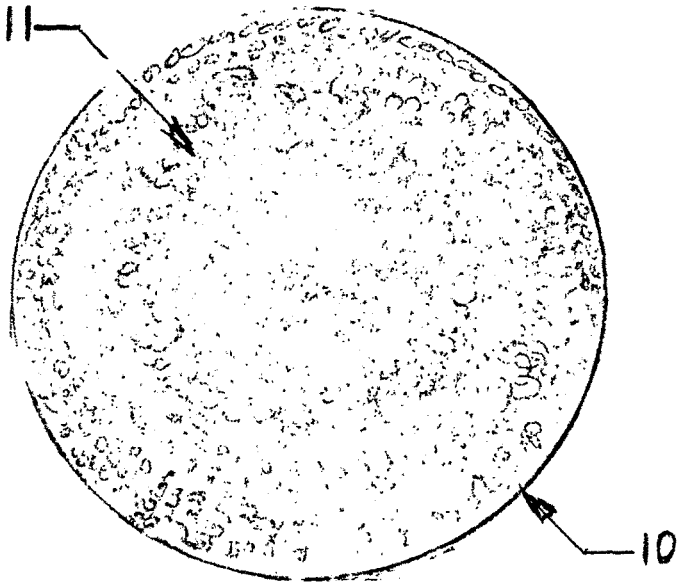
FIG. 1A is a view of the dual connector and strapless suspension device disc showing a peripheral "U" groove and with the loop half of a Velcro fastener attached to one surface of the disc as an example of where any of a plurality of other fasteners would be affixed to the disc for connection to the lower garment.
Figure 1C:
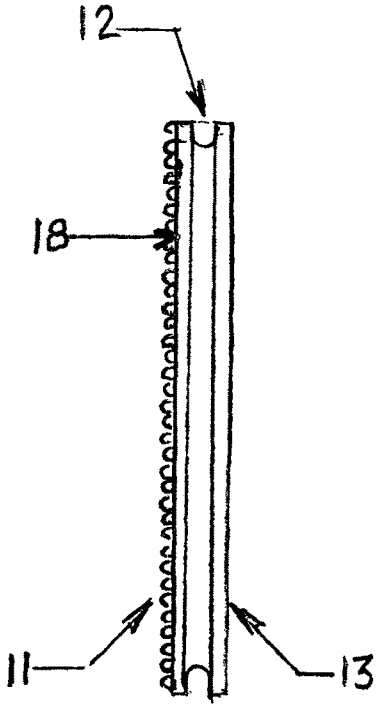
FIGS. 1B and 1C are bottom and side views respectively of the dual connector and strapless suspension device disc showing the disc groove with Velcro fastener attached to the outside face of the disc.
Figure 1B:
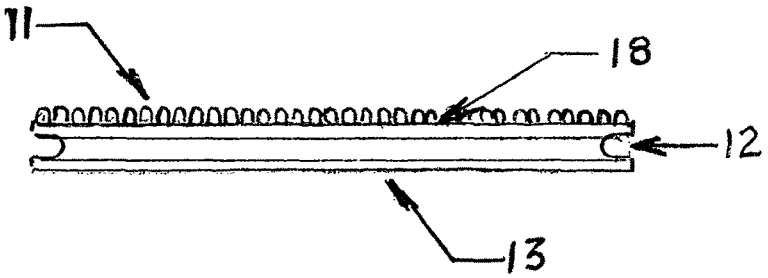

FIG. 1A shows a view of the dual connector and suspension device disc 10 which for illustration purposes is shown as a round disc, however any geometric shaped flat pad could be used as well. A "U" rope or cable peripheral edge groove 12 is shown around the edge of the disc but any geometric shaped groove would work as well. Velcro fastener (loop side) 11 is shown covering the lower garment fastener side mounting surface of the dual connector and strapless suspension device disc 10 for illustration purposes. Clips, buttons, snaps, hangers, or a plurality of other fasteners could be used as well to connect the tucked-in upper garment holding device disc 10 to the lower garment. The size of the disc is variable depending on the size and activity of the wearer, larger sizes for larger persons and those who are physically active and smaller sizes for petite and children wearers. The disc 10 can be made from any of a plurality of materials sufficiently rigid to keep from bending under the weight of the lower garment in addition to the motion forces of the wearer. Disc 10 materials or a combination there of, including metal, wood, wood, plastic, nylon, fiberglass, formica, ceramics, rubber are examples. The thickness of the disc 10 must be sufficient to provide a wide enough groove 12 that can contain both a double thickness of the upper garment material 17 in addition to the retainer device 19 yet leave enough groove wall thickness that will keep the upper garment 17 and the retainer device 19 from breaking out under the weight of the lower garment 16 in addition to the forces created by motions of the wearer.

Figure 2A:
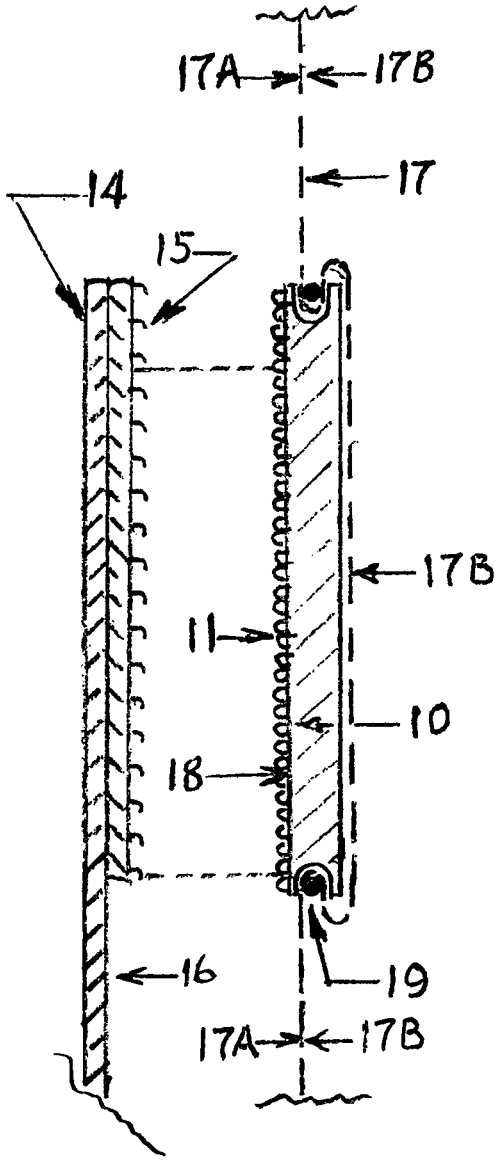
FIG. 2A is a diametrical section view showing how the tucked-in upper garment material is captured and held in the disc groove of the dual connector and strapless suspension device disc with a retainer device, and showing how (see dotted lines) the disc Velcro fastener, loop section connects to the lower garment waist band companion mating Velcro, hook section, affixed to the inside of the lower garment waist band.

FIG. 2A is a diametrical section view of the dual connector and suspension device showing how the upper garment 17 outside surface 17A and the inside surface 178, indicated by a dashed line, is captured in the disc groove 12 and retained in the groove with a retention ring 19. The disc 10 with Velcro loop section 11 installed is held by the upper garment 17, and faces the Velcro hook portion 15 of the Velcro fastener companion mating section attached to the inside waist band 14 of the lower garment 16 which when in contact with each other will fasten the upper garment 17 to the lower garment 16. The Velcro hook fastener 15 can be sewn on glued on, ironed on or clipped on the inside surface of the lower garment waist band providing a hidden connection of the upper 17 and lower 16 garments. A clipped on waist band attachment could be any of a plurality of fasteners that are affixed with a Velcro fastener surface 15 to mate with the dual connector and strapless suspension device disc 10 companion mating Velcro fastener 11.

Figure 2B:
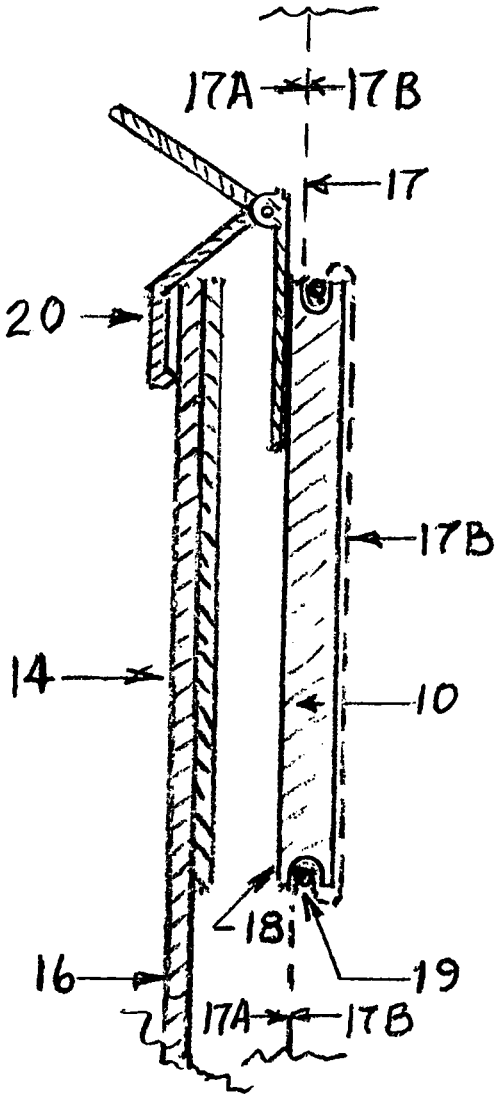
FIG. 2B is a diametrical section view showing how a tucked-in upper garment is captured in the dual connector and strapless suspension device disc and how a cam-closing clasp would be affixed to the dual connector and strapless suspension device disc as another example of how a plurality of other types of fasteners would be affixed, instead of Velcro to connect the lower and upper garments together using this connection and strapless suspension device.

FIG. 2B is a section view showing how a clip over-center fastener 20 could be directly mounted on the dual connector and suspension device disc 10 mounting surface 11 and positioned to clip directly to the lower garment waist band 14. Other fasteners, including buttons, snaps, hangers, over center clamps, or any of a plurality of other fasteners also could be similarly affixed or mounted on to the disc 10 lower garment mounting surface 18 to directly attach to the lower garment waist band 14 to maintain low visibility of the connection or a completely hidden connection of the tucked-in upper garment 17 to the lower garment 16.

Figure 3A:
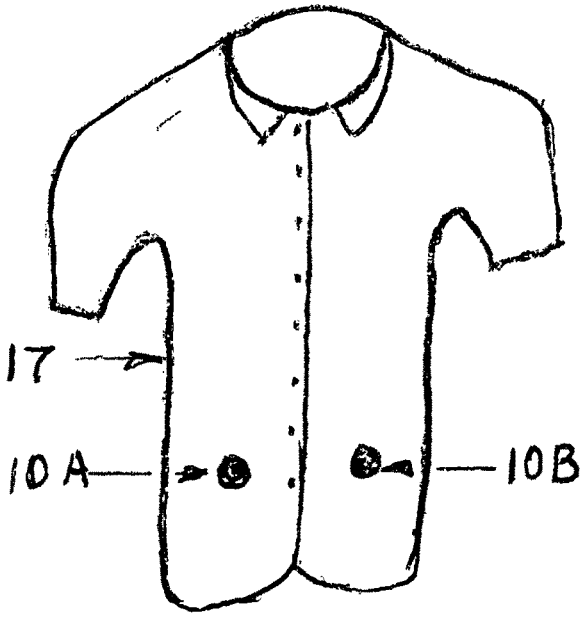
FIGS. 3A and 3B are isometric views showing how multiple dual connector and strapless suspension devices could be positioned on the tucked-in upper garment to mate with the lower garment fastener device.
Figure 3B:
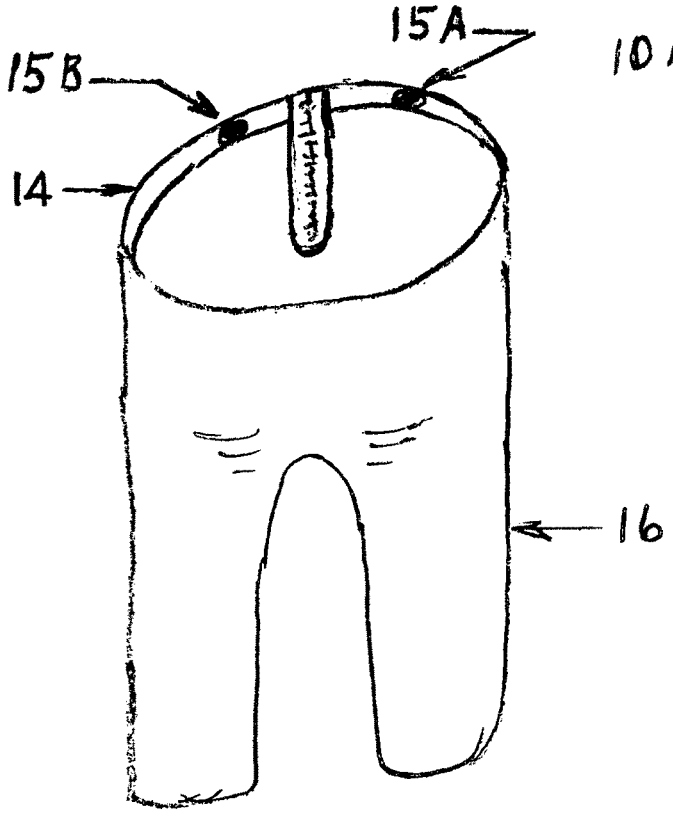

FIG. 3A and FIG. 3B are isometric drawings showing a pair of dual connector and strapless suspension devices 10A and 10B complete with Velcro loop fastener 11 attached to the upper garment 17 (FIG. 3A) with mating Velcro fastener, hook portion, 15A and 15B attached to the lower garment 16 waist band 14 FIG. 3B at positions opposite of the upper garment 17 positions 10A and 10B. Velcro hook fasteners 15A and 15B could be sewn on, ironed on, glued on, or clipped on to the waist band 14 of the lower garment 16. Velcro fasteners are used for illustration purposes, however, any of a myriad plurality of fasteners could be used as well and mounted to the dual connector and strapless suspension device disc 10 to connect the upper tucked-in garment to the inside of the waist band 14 of the lower garment. The dual connector and suspension devices 10A and 10B would be positioned on the upper garment 17 so that the connection to the lower garment 16 waist band 14 fasteners 15A and 15B would result in the lower garment 16 waist band 14 being at the wearer's desired position on the body. Two upper and lower garment connection positions are shown, however, additional devices could be added for heavier individuals and/or those with exertive body motions.

PATENT CITATIONS

| Cited patent | Filing date | Publication date | Applicant | Title |
|---|---|---|---|---|
| 5515544 | Jan. 30, 1995 | May 14, 1996 | Hosking | Method for conjoining clothes |
| 5623735 | Jan. 25, 1996 | April 1997 | Perry | Suspender to be worn w/belt |
| 6308338 | Aug. 14, 2000 | Oct. 30, 2001 | Caldwell | Trouser suspenders |
| 6397393 | Dec. 11, 2000 | Jun. 4, 2002 | Alger | Clothing combination comprising a self releasing bond |
| 6446268 | Oct. 15, 2001 | September 2002 | Lazarian | Garment support device |
| 6804834 | October 2004 | Mar. 3, 2003 | Mok | Suspender set |
| 20060185056A1 | Feb. 23, 2005 | Aug. 24, 2006 | Zwick | Shirt slot under garment Suspender |
| 20070033699A1 | Aug. 9, 2005 | Feb. 15, 2007 | Mars | Strapless belt loop suspenders |
| 20070033708A1 | Aug. 9, 2005 | Feb. 15, 2007 | Mars | Strapless belt loop suspenders |
| 20110083254A1 | Oct. 13, 2009 | Apr. 14, 2011 | Trutna | Magnetic clasp unit and suspender system |
| 20100186149A1 | Jan. 26, 2009 | Jan. 26, 2009 | Miller | Friction pad support, method of use |

The invention claimed is:

1. What is claimed is an upper garment including one of a shirt or blouse and lower garment including one of trousers, slacks, skirt or shorts, dual connector and strapless suspension device comprising: a flat disc-like base element with a peripheral-edge groove for capturing or holding the upper garment material, any one of a plurality of retainer devices for holding the material of the tucked-in upper garment in the groove without upper garment modification or alteration, and any one of a plurality of fastener devices affixed to the flat disc-like base element's exposed surface for a connection of the flat disc-like element, with the upper garment attached therewith, to the inside of a waist band of the lower garment, hidden from view, behind and below the top edge of the lower garment waistband, and with this dual connection and strapless hidden suspension device concept; easy removal of the dual disc connector and strapless suspension device is attained, a positive tucked-in upper garment while in use, a hidden lower garment/tucked-in upper garment attachment is attained, upper garment suspension support of the lower garment is attained, a neat tucked-in appearance is attained while in use, and easy lower garment disconnection is attained for daily conveniences.

2. The dual connector and strapless suspension device of claim 1 wherein; the disc base element is a plane pad of geometric shape, thick enough to permit a sufficiently wide peripheral edge groove to contain a double thickness of upper garment material plus the thickness of the groove retainer device, yet leaving an adequate enough groove wall thickness to prevent groove side wall breakout resulting from lower garment weight in addition to wearer motion forces exerted on the groove walls.

3. The dual connector and strapless suspension device of claim 1 wherein; the disc base element is fabricated from any one or a combination of a plurality of rigid materials, including but not limited to: metal, wood, plastic, fiberglass, hard rubber, nylon, ceramics, stone and formica.

4. The dual connector and strapless suspension device of claim 1 wherein; the lower garment is attached to the disc base element by means of one of permanent or heat-sensitive adhesive, thermal bonding, rivets, screws, bolts, welding, brazing or soldering.

5. The dual connector and strapless suspension device of claim 1 wherein the upper garment material groove retention device is one of any of a plurality of devices including snap rings, split rings, wire rings, rope, string, shoe laces, clamps, wire or plastic ties; any retainer devices that when tightened down, are self-holding in place, and easily released for disc removal from the upper garment.

6. The dual connector and strapless suspension device of claim 1, wherein; the disc fastener part, is affixed to the lower garment inside waist band with connectivity methods including but not limited to: permanent adhesive, thermal bonding, epoxy bond, hooked-on, buttoned-on clipped-on, riveted-on, or clamped-on.

7. The dual connector and strapless suspension device of claim 1, wherein; the attachment of the upper garment to the lower garment is made with a plurality of fastener devices not limited to: clips, clamps, Velcro, buttons, snaps, and hooks.

8. The dual connector and strapless suspension device of claim 1, wherein; the disc base element peripheral edge groove is of a geometric shape of sufficient cross section depth and width to contain a double thickness of upper garment material plus the width of the retainer device.

9. The dual connector and strapless suspension device of claim 1, wherein; the upper garment suspension support of the lower garment distributes the forces created by the weight of the lower garment in addition to wearer imposed motion forces, across the total shoulder area of the wearer.

10. The dual connector and strapless suspension device of claim 9 wherein; a tucked-in upper garment can be the lower garment suspension support or suspenders for any untucked-in upper outer garment wear.

11. The dual connector and strapless suspension device of claim 1, wherein; the attachment of the disc base element to the upper garment is accomplished by draping the outside surface of the upper garment material over the back surface of the disc at a position on the upper garment corresponding to where the wearer plans to position the lower garment waistline on their body, and then wrapping the retainer device around the disc perimeter edge and wedging the said upper garment material into the groove by tightening the retainer device, with the lower garment disc fastener facing outwards towards the lower garment waistline mating fastener attachment position.

* * * * *